United States Patent [19]

Gilmore et al.

[11] Patent Number: 4,627,617

[45] Date of Patent: Dec. 9, 1986

[54] EXERCISE DEVICE WITH OPPONENT SUPPLIED RESISTANCE

[75] Inventors: Douglas D. Gilmore, 501 Lookout Mtn Rd., Golden, Colo. 80401; G. Michael Harz, Golden, Colo.

[73] Assignee: Douglas D. Gilmore, Lakewood, Colo.

[21] Appl. No.: 740,834

[22] Filed: Jun. 3, 1985

[51] Int. Cl.[4] ..... A63B 21/00

[52] U.S. Cl. ..... 272/120; 272/126; 272/902

[58] Field of Search ..... 272/126, 134, 143, 93, 272/902, 120

[56] References Cited

U.S. PATENT DOCUMENTS

| | | | |
|---|---|---|---|
| 681,664 | 8/1901 | Addleman . | |
| 774,738 | 11/1904 | Chavez . | |
| 1,572,802 | 2/1926 | Layman . | |
| 2,782,033 | 2/1957 | Ugartechea | 272/67 |
| 2,937,023 | 5/1960 | Seymour et al. | 272/80 |
| 3,069,162 | 12/1962 | Samuel | 272/79 |
| 3,129,940 | 4/1964 | Lauro | 272/79 |
| 3,301,555 | 1/1967 | Sicherman | 273/1 |
| 3,462,142 | 8/1969 | Sterndale | 272/143 X |
| 3,743,280 | 7/1973 | Martinez | 272/57 |
| 4,047,714 | 9/1977 | Powell | 272/116 |
| 4,220,328 | 9/1980 | Crush, Jr. | 272/116 |
| 4,252,314 | 2/1981 | Ceppo | 272/117 |
| 4,257,592 | 3/1981 | Jones | 272/126 |
| 4,284,274 | 8/1981 | Boothe | 272/116 |
| 4,422,636 | 12/1983 | de Angeli | 272/117 |

FOREIGN PATENT DOCUMENTS

| | | | |
|---|---|---|---|
| 425012 | 2/1926 | Fed. Rep. of Germany | 272/126 |
| 2433202 | 2/1975 | Fed. Rep. of Germany | 272/126 |
| 1321733 | 2/1963 | France | 272/126 |
| 1333776 | 6/1963 | France | 272/126 |

*Primary Examiner*—Richard J. Apley
*Assistant Examiner*—John L. Welsh
*Attorney, Agent, or Firm*—W. Scott Carson

[57] ABSTRACT

An exercise device for use by two individuals wherein they can work out against one another rather than working alone against weights. The device includes a frame and pulley system through which a flexible cable is run. Handlebars are attached to each end of the cable and in operation, the individuals position themselves on opposing sides of the symmetrical frame and grip one of the bars. In performing exercises, the individuals preferably assume mirror-image positions and then continuously apply an upward force on their bar with each individual alternately applying a greater upward force than the other. In this manner, each individual alternately draws the cable through the frame toward him while the other person resists such movement.

15 Claims, 8 Drawing Figures

Fig. 3
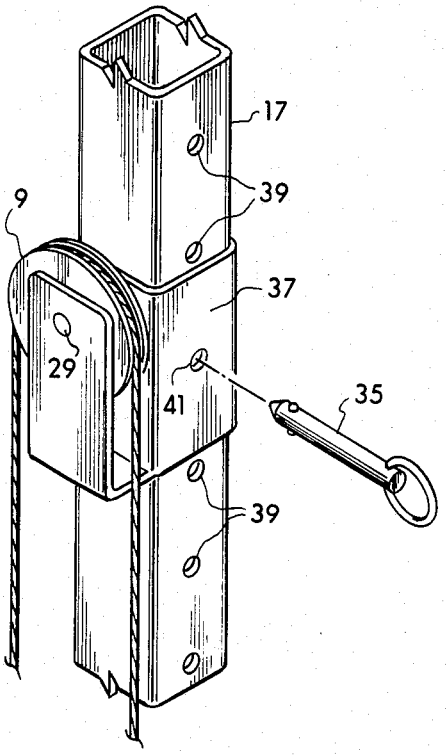
Fig. 4
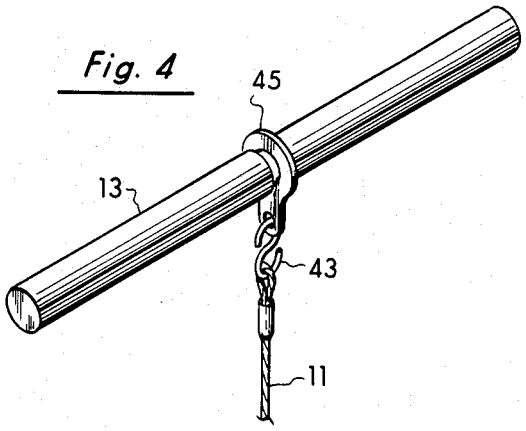
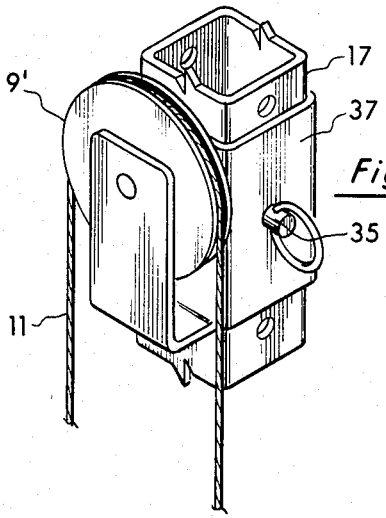
Fig. 8
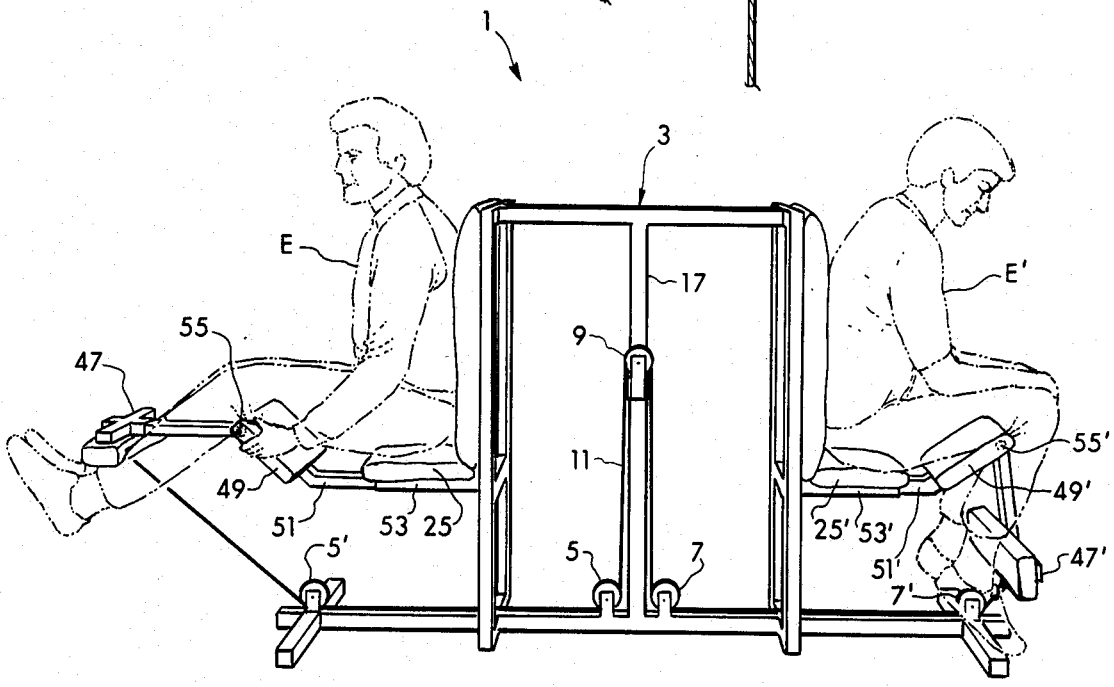
Fig. 5

EXERCISE DEVICE WITH OPPONENT SUPPLIED RESISTANCE

FIELD OF THE INVENTION

This invention relates to the field of exercise devices and methods.

BACKGROUND OF THE INVENTION AND PRIOR ART

Weight lifting, power lifting, and body building have traditionally been individual sports wherein the person works out by himself using weights. Such weight devices can be very simple and basic like bar bells or more sophisticated like U.S. Pat. Nos. 4,426,636 to Angeli and 4,252,314 to Ceppo. In contrast to working against weights, there are also exercise devices in which two or more individuals work against each other rather than against dead weight. Examples of such devices are U.S. Pat. Nos. 2,937,023 to Seymour, 3,129,940 to Lauro, 4,284,274 to Boothe, 774,738 to Chavez, 3,069,169 to Samuel, 2,782,033 to Ugartechea, 4,220,328 to Crush, and 3,301,555 to Sicherman. Still other devices pit the individuals against one another through a braking arrangement such as U.S. Pat. No. 1,572,802 to Layman or team the individuals together against the braking force of the device such as U.S. Pat. No. 681,684 to Addeleman. Exercise devices are also available in which the individuals work out together but not against each other such as U.S. Pat. Nos. 4,047,714 to Powell and 3,743,280 to Martinez.

In regard to weight-free exercise devices such as Seymour, Lauro, and Boothe, they offer several fundamental advantages over working with weights. For example, there is the safety factor of not having weights which might fall or otherwise be mishandled and injure the user. Also, weights offer significant inertia and momentum particularly at the beginning and end of their movement whereas gradual increases and decreases in tension on the muscles are preferred. Such gradual changes can be offered in weight-free devices as the opposing individual can almost instantaneously respond to increases and decreases in tension applied by the other party. With weights and working alone, a person may have a tendency to cheat on a exercise as, for example, by jerking the bar up rather than bringing it up gradually. This may be particularly true if the lifter is near his limit on weight or repetitions. However, with weight-free devices such as Seymour, an individual cannot cheat as the other person providing the resistance will keep him honest. Weight-free devices also offer some variety to lifters who usually work out alone and such devices can additionally provide interesting one-on-one competition such as illustrated by Ugartechea. Further, particular muscles or portions of muscles can be exercised as desired by having the other person infinitely and instantaneously vary the resistance force at the proper time and in the proper amounts.

Although weight-free devices offer many advantages, they have to date been very limited in the number and type of exercises that can be done with them. That is, lifters have not been able to do the more traditional exercises (e.g., curls, leg extensions, presses) on such weight-free devices and the use of such devices has more or less been limited to tug-of-war type encounters such as illustrated by Seymour, Lauro, and Boothe. With this in mind, the present invention was developed wherein the exercisers can work against one another without weights and still do virtually all of the traditional exercises including curls, leg extensions, and presses. Further, the present invention in the preferred embodiment allows the exercisers to perform a wide variety of exercises on the same, basic apparatus with only a minimum of simple and quick adjustments to it.

SUMMARY OF THE INVENTION

This invention involves an exercise device for use by two individuals wherein they can work out against one another rather than working alone against weights, springs, or the like. The device includes a frame and pulley system through which a flexible cable is run. Handlebars or user engaging members are attached to each end of the cable and in operation, the individuals position themselves on opposing sides of the symmetrical frame and grip one of the bars. In performing exercises, the individuals preferably assume mirror-image positions and then continuously apply an upward force on their bar with each individual alternately applying a greater upward force than the other. In this manner, each individual alternately draws the cable through the frame toward him while the other person resists such movement. In doing so, the two individuals always hold the same muscles in tension while exercising on the device for maximum development of the muscles in the shortest amount of time. Additionally, the run distance of the cable through the frame in the preferred embodiment can be selectively changed in order to modify the positioning of the handlebars on the ends of the cable relative to each other. In this manner, the individuals can then perform a variety of exercises on the device.

BRIEF DESCRIPTION OF THE DRAWINGS

FIG. 3 is an enlarged view of the centrally mounted pulley of FIGS. 1 and 2 which can be selectively raised or lowered to alter the run distance of the cable through the frame. In this manner, the positioning of the handlebars attached to the ends of the cable can be adjusted for various exercises.

FIG. 4 illustrates a manner in which each handlebar can be removeably secured to an end portion of the cable member.

FIG. 5 illustrates the basic frame with thigh supports added so the exercisers can do leg extensions.

FIG. 8 is a view similar to FIG. 3 illustrating an alternate manner in which the run of the cable through the frame can be changed by simply substituting a larger pulley for the central pulley of FIG. 1.

DETAILED DESCRIPTION OF THE PREFERRED EMBODIMENTS

Figure 1:
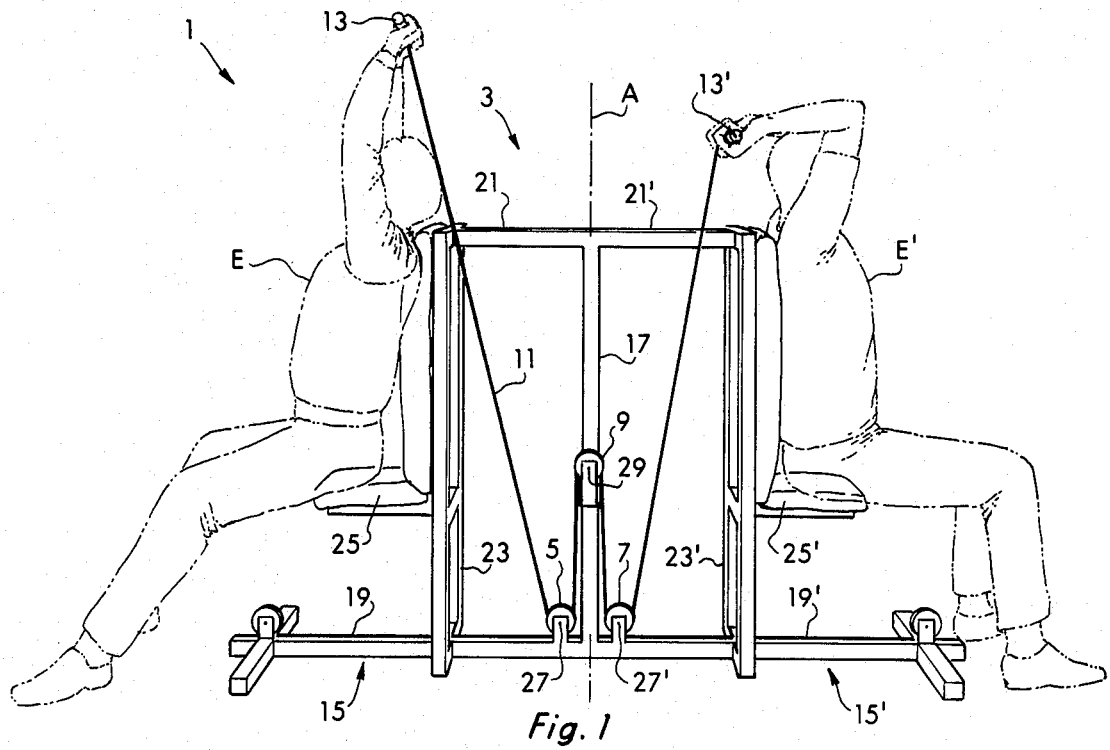
FIG. 1 illustrates the basic frame and pulley arrangement of the present invention with the two exercisers being shown in dotted lines sitting on the oppositely facing seats and performing arm exercises.

As best seen in FIG. 1, the exercise device 1 of the present invention includes a frame 3, a three pulley arrangement of pulley members 5, 7, and 9, flexible cable members 11, and handlebars 13 and 13'. The frame 3 is preferably symmetrical in relation to the central, vertical plane A and has mirror-image side portions 15 and 15' extending outwardly of the central plane A. Each side portion 15 and 15' shares the common, central support 17 and additionally has a base section 19 and 19', support members 21 and 21', and vertically extending supports 23 and 23' upon which are mounted oppositely facing seat members 25 and 25'. In the preferred embodiment of FIG. 1, the pulley members 5 and 7 are mounted to a respective side portion 15 and 15' of the frame 3 for rotation about horizontal axes 27 and 27'. Additionally, the third pulley member 9 is mounted to the support 17 of the frame 3 for rotation about the horizontal axis 29 which is preferably parallel to axes 27 and 27'.

In preparing the preferred embodiment of FIG. 1 for use, the flexible cable 11 is run through the frame 3 from one side portion to the other with the cable member 11 being received partially about the pulley members 5 and 7 below the respective horizontal, rotational axes 27 and 27'. The cable member 11 is additionally received partially about the third pulley member 9 above its horizontal axis 29. In operation as shown in FIG. 1, the two exercisers E and E' position themselves adjacent one of the side portions 15 and 15' of the frame 3 and grip the handlebars 13 and 13' on the end portions of the cable member 11. The exercisers then continuously apply an upward force (i.e., one with an upward component) to the handlebars 13 and 13' with each individual alternately applying a greater upward force than the other. In this manner, each exerciser E and E' alternately draws the cable member 1 through the frame 3 toward him while the other individual resists such movement. In doing so, each exerciser E and E' always holds the same muscles in tension while exercising on the device 1 for maximum development.

Figure 2:
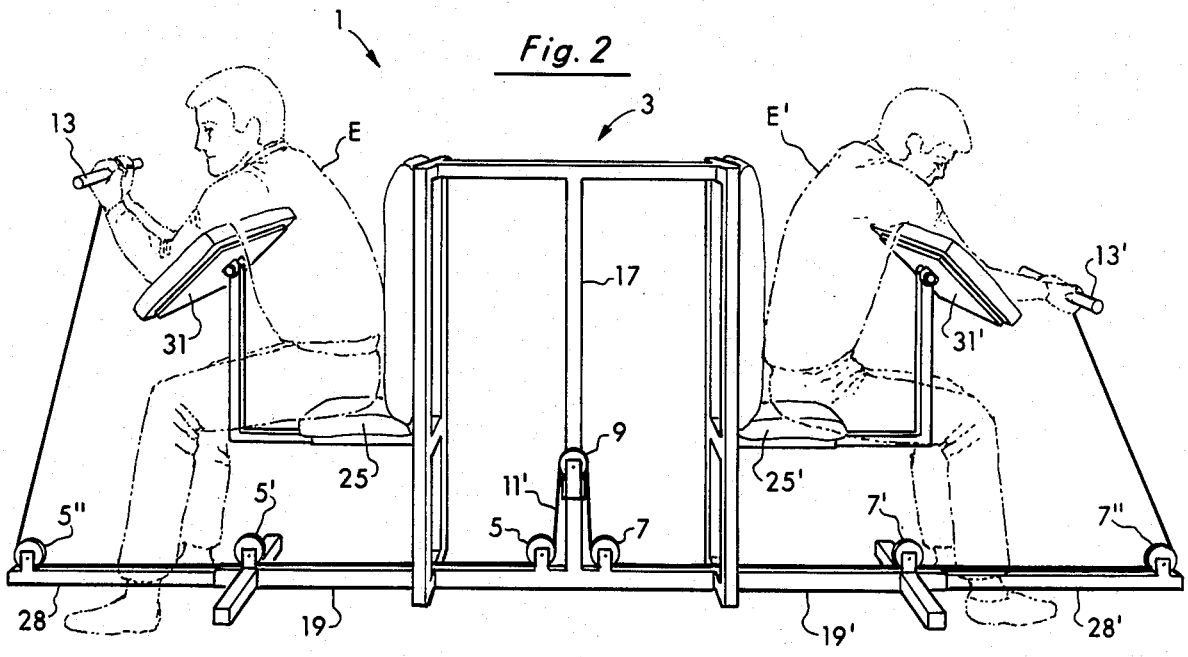
FIG. 2 illustrates a modification to the basic frame of FIG. 1 in which upper arm supports are additionally mounted to the frame and extensions are added to the base of the frame. In this embodiment, the cable is longer than the one in FIG. 1 and the exercisers are shown in dotted lines performing curls.

The running of the cable member 11 between pulley members 5 and 7 in FIG. 1 is critical to the method and apparatus of the present invention as it enables the exercisers E and E' to apply forces well in excess of their body weights. It further enables the device 1 to be easily and quickly adapted to allow the exercisers E and E' to perform traditional exercises (curls, leg extensions, presses) on a weight-free apparatus. For example, in the embodiment of FIG. 2, upper arm supports 31 and 31' have been mounted to the frame 3 adjacent each seat member 25 and 25'. Further, in FIG. 2, extensions 28 and 28' have been added to each base section 19 and 19' and the cable member 11' has been run through the frame 3 in a different manner than in FIG. 1. Nevertheless, the cable member 11' still passes underneath the last pulleys 5'' and 7'' leading to the handlebars 13 and 13'. The pulley members 5'' and 7'' are positioned outwardly of the seat members 25 and 25' whereas pulley members 5 and 7 in FIG. 1 are inwardly thereof. However, in both cases, the cable members 11 and 11' are run under the last pulley members leading to the handlebars 13 and 13'. In the position of FIG. 2, the exercise device 1 can then be used to do arm curls as shown.

Figure 6:
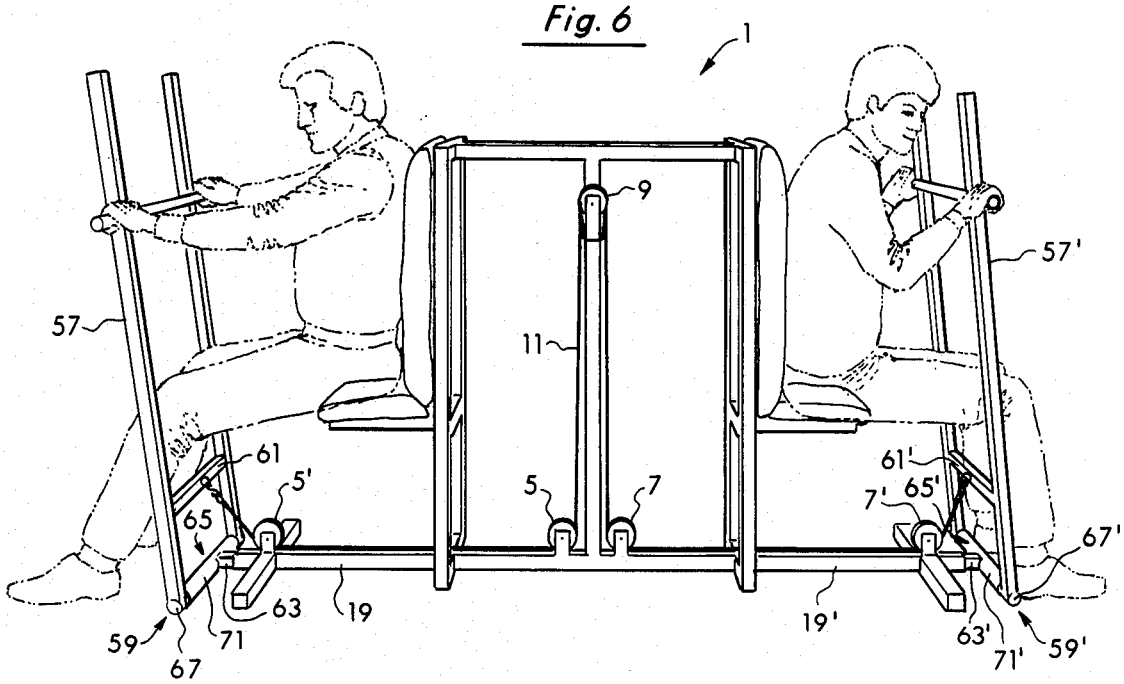
FIG. 6 is a view of the exercisers doing presses on the exercise device by gripping handlebars that are pivotally mounted to the basic frame.
Figure 7:
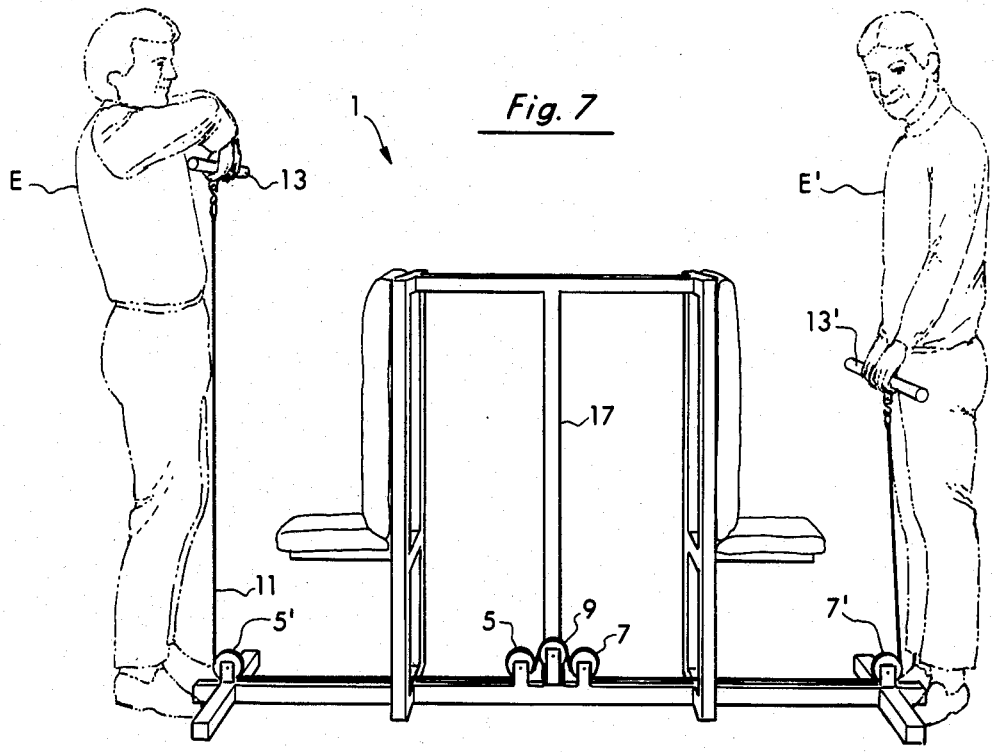
FIG. 7 illustrates the basic frame with the cable strung so that the exercisers can do yet another exercise.

The pulley member 9 in FIGS. 1 and 2 is adjustably mounted on the vertical support 17 as shown in FIG. 3. In this manner, the pulley member 9 can be selectively positioned either upwardly or downwardly to alter the run distance of the cable member 11 of FIG. 1 between pulley members 5 and 7 and similarly alter the run distance of the cable member 11' in FIG. 2. This is accomplished as illustrated in FIG. 3 by removing the pin 35, sliding the pulley mounting 37 up or down to align a different pair of holes 39 and 41, and re-inserting the pin 35. In dong so, the handlebars 13 and 13' on the end portions of the cable member 11 in FIG. 1 can be positioned as desired relative to each other or the frame 3 to suit the precise needs of the exercisers E and E'. Further, and more importantly, it enables the exercisers to adapt the basic device 1 of FIG. 1 for use in performing a wide variety of exercises such as shown in FIGS. 1 and 5–7 without having to change the cable member 11. That is, the exercise device 1 of FIG. 1 offers the versatility that the cable member 11 can be removed and replaced with a longer one such as cable member 11 in FIG. 2 to perform certain exercises. Or, the same cable member 11 of FIG. 1 can be used in the performance of a number of different exercises such as shown in FIG. 5–7 by merely adjusting the position of the pulley member 9 to alter the run distance of the cable member 11 and move the end portions thereof relative to each other or the frame 3.

The end portions of cable member 11 are removeably attached to the handlebars 13 and 13'. This can be accomplished in any number of ways including the simple S hook 43 of FIG. 4 which extends between the eyelets on cable member 11 and the handlebar attachment 45. In this manner as best seen in FIGS. 1 and 5–7, the run distance of the cable member 11 through the frame 3 between the pulley members 5 and 7 and pulley member 5' and 7' can be easily and quickly altered to vary the locations of the end portions of the cable member 11 for the performance of a variety of exercises. For example, in FIG. 5 the bars 13 and 13' of FIG. 1 are replaced with padded leg extension bars 47 and 47'. Although usable in other exercises, the padded bars 47 and 47' of FIG. 5 as shown are being used by the exercisers E and E' to do leg extensions. More specifically, the embodiment of FIG. 5 includes thigh supports 49 and 49' which are removeably mounted to the frame 3 adjacent the seat members 25 and 25'. Like the arm supports 31 and 31' of FIG. 2, this can be accomplished by simply telescoping or receiving the pieces 51 and 51' in mating rectangular pipe pieces 53 and 53' supporting the seats 25 and 25' and securing the pieces in the desired places by an arrangement such as in FIG. 3 or by a simple set screw. In use, the padded bars 47 and 47' of FIG. 5 are pivotally mounted at 55 and 55' to the thigh supports 49 and 49' and the exercisers E and E' simply engage or grip the padded handlebars 47 and 47' with their legs and work against one another to perform leg extensions. The basic device 1 of FIG. 1 can also be easily and quickly adapted to do presses as shown in FIG. 6. This can be accomplished by merely raising the pulley member 9, replacing the handlebar structures 57 and 57' which are pivotally mounted at 59 and 59' to the base sections 19 and 19', and attaching the end portions of the cable member 11 to the cross bars 61 and 61'. The pivotal mountings 59 and 59' of FIG. 6 involve inserting the legs 63 and 63' of T extensions 65 and 65' into the base sections 19 and 19', securing the extensions in the desired place in a manner similar to FIG. 3 or with set screws, and moving the handlebar structures 57 and 57' with the pipe sections 67 and 67', thereof pivotally received in the pipe arms 71 and 71' of the T extensions 65 and 65'. Thereafter, for example, the device 1 can be further adapted so the exercisers E and E' can do the movements illustrated in FIG. 7 by merely lowering pulley member 9 and reattaching the handlebars 13 and 13'.

As illustrated in FIG. 8, the run distance of cable 11 through the frame 3 can also be adjusted in a number of other ways including substituting a pulley 9' which has a larger or smaller diameter than the pulley member 9. In the preferred embodiment, the run of the cable member is substantially in a common plane perpendicular to plane A and the end portions of the cable member in use may extend away from each other (FIG. 1, 5, and 6) or toward each other (FIG. 5) or even parallel to one another (FIG. 7) depending upon the exercises being performed. However, if desired, the cable member can be run so that the working positions of the device are side-by-side rather than mirror-images of one another.

While several embodiments of the invention have been disclosed and described in detail, it is understood that various changes and modifications can be made to them without departing from the scope of the invention.

We claim:

1. An exercise device primarily intended for use by two individuals working against one another to provide the resistance to movement of the other rather than working alone against dead weight, said exercise device including:

a flexible cable member having first and second end portions, first and second user engaging members and means for attaching said first user engaging member to the first end portion of said cable member and means for attaching said second user engaging member to the second end portion of said cable member, and a frame having first and second side portions, said first and second side portions extending away from each other relative to a vertical plane centrally located relative to said frame, first and second seat members and means for respectively mounting said seat members to the first and second side portions of said frame on opposite sides of the central, vertical plane of said frame with said seat members facing in opposite directions, and first and second pulley members, and means for mounting said first pulley member to the first side portion of said frame for rotation about a first, horizontal axis and means for mounting said second pulley member to the second side portion of said frame for rotation about a second, horizontal axis wherein said cable member is run through said frame from one side portion to the other side portion with said cable member being received partially about the respective pulley members below the respective horizontal, rotational axes thereof whereby the two individuals can sit on respective ones of said seat members, grip a respective one of said user engaging members, and continuously apply an upward force thereto with each individual alternately applying a greater upward force than the other to alternately draw the cable member through the frame toward him while the other individual resists such movement wherein the two individuals always hold the same muscles in tension while exercising on the device

2. The exercise device of claim 1 further including means for selectively altering the run distance of said cable member between said first and second pulley members in order to selectively position the end portions of said cable member at different locations so that the individuals can perform different exercises on the device. wherein the run distance is the distance the cable travels from the bottom of the first pulley member to the bottom of the second pulley member.

3. The exercise device of claim 1 further including a third pulley mounted to said frame for rotation about a third, horizontal axis, and said cable member being run through said frame from one side portion to the other side portion with said cable member being received partially about the first and second pulley members below the respective first and second horizontal axes thereof and being received partially about the third pulley member above the third horizontal axis thereof.

4. The exercise device of claim 3 further including means for selectively positioning said third pulley member in at least two different positions relative to said first and second pulley members to selectively alter the run distance of the cable member between the first and second pulley members, wherein the run distance is the distance the cable travels from the bottom of the first pulley member to the bottom of the second pulley member.

5. The exercise device of claim 3 wherein said first, second, and third axes are parallel to each other.

6. The exercise device of claim 1 wherein the run of said cable member from one end portion to the other is substantially in a common plane.

7. The exercise device of claim 1 wherein said first and second side portions extend away from each other relative to a vertical plane centrally located relative to said frame and wherein said first and second pulley members are respectively mounted outwardly of the respective first and second seat members relative to said vertical plane.

8. The exercise device of claim 1 wherein said first and second side portions extend away from each other relative to a vertical plane centrally located relative to said frame and wherein said first and second pulley members are respectively mounted inwardly of the respective first and second seat members relative to said vertical plane.

9. The exercise device of claim 1 further including first and second upper arm supports and means for respectively mounting the arm supports to said frame adjacent respective ones of said seat members.

10. The exercise device of claim 9 wherein said respective support mounting means mount said arm supports outwardly of the respective first and second seat members relative to said vertical plane.

11. The exercise device of claim 1 further including first and second thigh supports and means for respectively mounting the thigh supports to said frame adjacent respective ones of said seat members.

12. The exercise device of claim 11 wherein said respective support mounting means mount said thigh supports outwardly of the respective first and second seat members relative to said vertical plane.

13. The exercise device of claim 11 wherein said user engaging members are leg extension bars pivotally attached to said thigh supports.

14. The exercise device of claim 1 further, including means for pivotally mounting said engaging members to respective side portions of said frame.

15. The exercise device of claim 1 wherein said user engaging members are detachable cylindrical handlebar members.

* * * * *